US010274180B2

(12) United States Patent
Shine et al.

(10) Patent No.: US 10,274,180 B2
(45) Date of Patent: Apr. 30, 2019

(54) MODULAR LIGHTING SYSTEM

(71) Applicants: Jin Choi Shine, Brookline, MA (US); Thomas Adam Slier Shine, Brookline, MA (US)

(72) Inventors: Jin Choi Shine, Brookline, MA (US); Thomas Adam Slier Shine, Brookline, MA (US)

( * ) Notice: Subject to any disclaimer, the term of this patent is extended or adjusted under 35 U.S.C. 154(b) by 116 days.

(21) Appl. No.: 14/951,319

(22) Filed: Nov. 24, 2015

(65) Prior Publication Data

US 2016/0146445 A1 May 26, 2016

Related U.S. Application Data

(60) Provisional application No. 62/283,792, filed on Sep. 12, 2015, provisional application No. 62/123,682, filed on Nov. 24, 2014.

(51) Int. Cl.
*F21K 9/20* (2016.01)
*F21V 21/096* (2006.01)
(Continued)

(52) U.S. Cl.
CPC ..... *F21V 23/06* (2013.01); *F21K 9/20* (2016.08); *F21S 2/005* (2013.01); *F21V 21/096* (2013.01);
(Continued)

(58) Field of Classification Search
CPC ..... F21K 9/20; F21S 2/005; F21V 21/096; F21V 21/29; F21V 23/06; F21Y 2103/10;
(Continued)

(56) References Cited

U.S. PATENT DOCUMENTS 3,840,842 A * 10/1974 Gabryelewicz ..... F21S 2/005 362/217.16
4,581,687 A 4/1986 Nakanishi
(Continued)

FOREIGN PATENT DOCUMENTS

JP 54-114788 U1 8/1979
JP 2011060493 A 3/2011
(Continued)

OTHER PUBLICATIONS

International Searching Authority, International Search Report—International Application No. PCT/US2015/062537, dated Mar. 15, 2016, together with the Written Opinion of the International Searching Authority, 16 pages.
(Continued)

*Primary Examiner* — Tsion Tumebo
(74) *Attorney, Agent, or Firm* — Sunstein Kann Murphy & Timbers LLP

(57) ABSTRACT

A modular lighting system includes a set of interconnected reconfigurable illuminating modules and corresponding intermediate connectors. Each illuminating module includes a light source and at least one connecting area. Each connecting area includes an illuminating module coupling assembly having at least one ferromagnetic member and having electrically conductive members electrically coupled to the light source. Each intermediate connector has a plurality of intermediate connector coupling assemblies electrically coupled to one another. Each intermediate connector coupling assembly includes a ferromagnetic component that is configured to be magnetically coupled with the ferromagnetic member so that one intermediate connector coupling assembly is electrically coupled to one illuminating module coupling assembly, and the two coupling assemblies
(Continued)

are held in electrical contact with one another by magnetic force.

21 Claims, 12 Drawing Sheets

(51) Int. Cl.

| | |
|---|---|
| ***F21V 23/06*** | (2006.01) |
| ***F21V 21/29*** | (2006.01) |
| ***H01R 13/62*** | (2006.01) |
| ***F21S 2/00*** | (2016.01) |
| *F21Y 103/10* | (2016.01) |
| *F21Y 107/30* | (2016.01) |
| *F21Y 115/10* | (2016.01) |

(52) U.S. Cl.
CPC ..... *F21V 21/29* (2013.01); *H01R 13/6205* (2013.01); *F21Y 2103/10* (2016.08); *F21Y 2107/30* (2016.08); *F21Y 2115/10* (2016.08)

(58) Field of Classification Search
CPC ..... F21Y 2107/30; F21Y 2115/10; H01R 13/6205
USPC ..... 362/234, 237, 249.01, 249.02, 311.01, 362/398; 29/825
See application file for complete search history.

(56) References Cited

U.S. PATENT DOCUMENTS 4,719,549 A 1/1988 Apel
5,559,681 A * 9/1996 Duarte ..... F21V 21/08 362/231
6,126,303 A * 10/2000 Gross ..... B60Q 1/2657 362/231
6,853,151 B2 * 2/2005 Leong ..... H05B 33/0803 315/185 R
6,969,294 B2 * 11/2005 Vicentelli ..... A63F 9/34 446/129
7,217,023 B2 5/2007 Iwasa et al.
7,322,873 B2 * 1/2008 Rosen ..... A63H 33/042 446/124
7,731,558 B2 6/2010 Capriola
7,762,695 B2 * 7/2010 Lanczy ..... F21V 21/005 362/217.13
8,187,006 B2 * 5/2012 Rudisill ..... H01R 11/30 362/249.06
8,388,162 B2 * 3/2013 Park ..... G02F 1/133603 362/249.02
8,641,229 B2 * 2/2014 Li ..... F21V 17/007 362/219
8,864,546 B1 * 10/2014 Capriola ..... A63H 33/042 331/3
9,167,636 B2 * 10/2015 Jin ..... F21V 23/06
2002/0114155 A1 * 8/2002 Katogi ..... F21S 2/00 362/219
2004/0018473 A1 * 1/2004 Tusacciu ..... A63H 33/046 434/73
2009/0267533 A1 * 10/2009 Lee ..... G09F 9/33 315/294
2010/0271804 A1 * 10/2010 Levine ..... F21V 21/005 362/35
2011/0260096 A1 10/2011 Atarashi
2011/0310604 A1 12/2011 Shimizu et al.
2012/0140474 A1 * 6/2012 Jurik ..... F21S 2/00 362/249.09
2012/0201021 A1 8/2012 Todd

FOREIGN PATENT DOCUMENTS

JP 2011-233839 A 11/2011
JP 2012185930 A 9/2012
WO 2011058486 A2 5/2011

OTHER PUBLICATIONS

International Searching Authority, International Search Report and Written Opinion for International Application No. PCT/US2017/051624, 10 pages, dated Jan. 9, 2018.

* cited by examiner

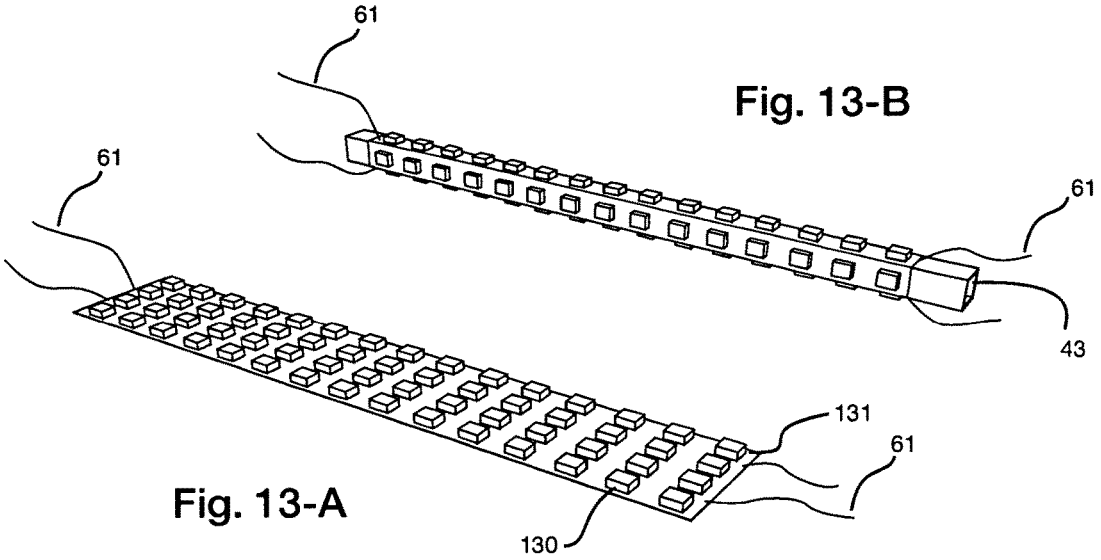
Fig. 13-B
Fig. 13-A
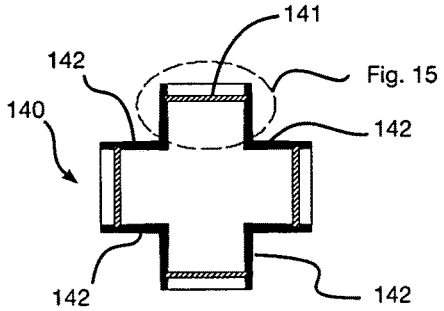
Fig. 14
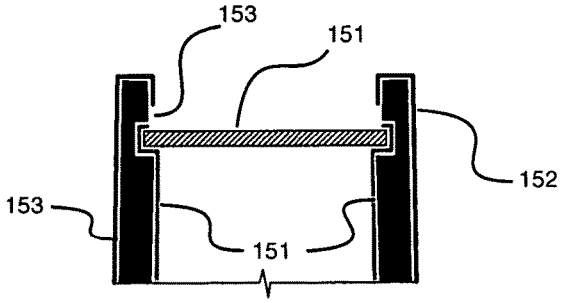
Fig. 15
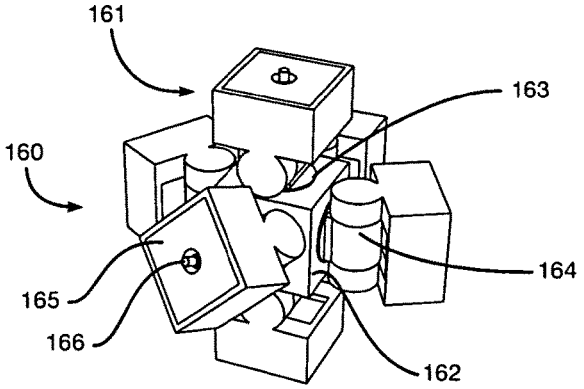
Fig. 16

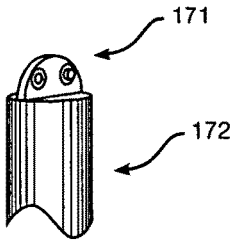
Fig. 17-A
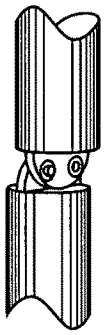
Fig. 17-B
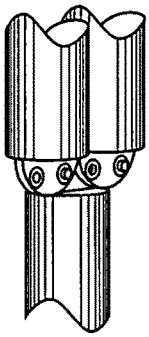
Fig. 17-C
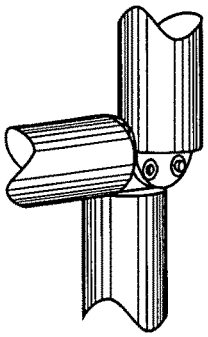
Fig. 17-D
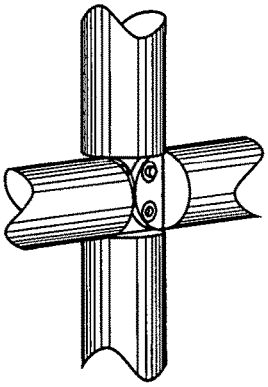
Fig. 17-E
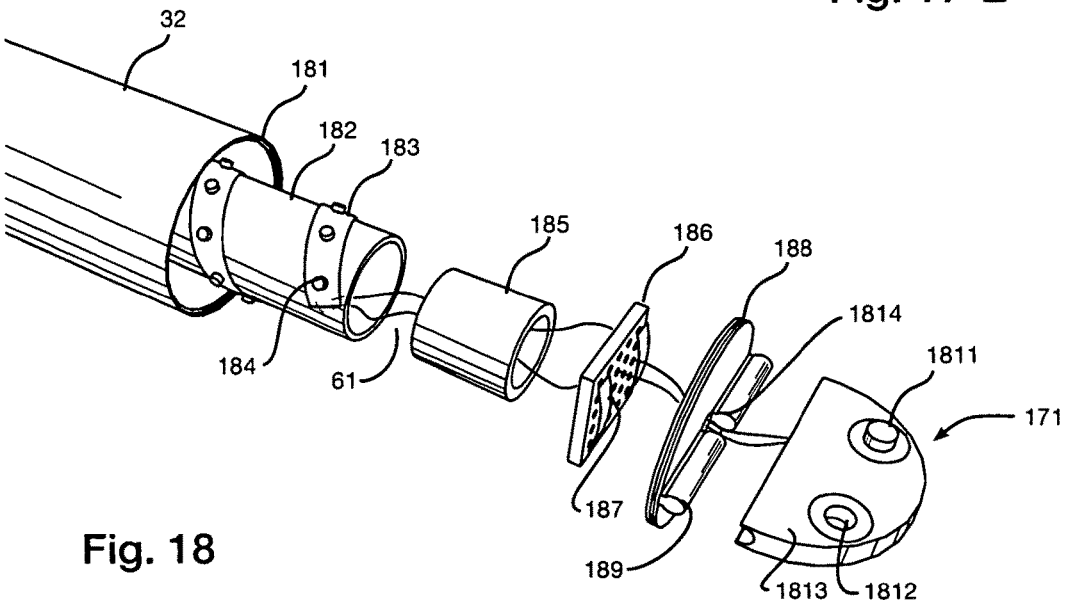
Fig. 18

Fig. 30
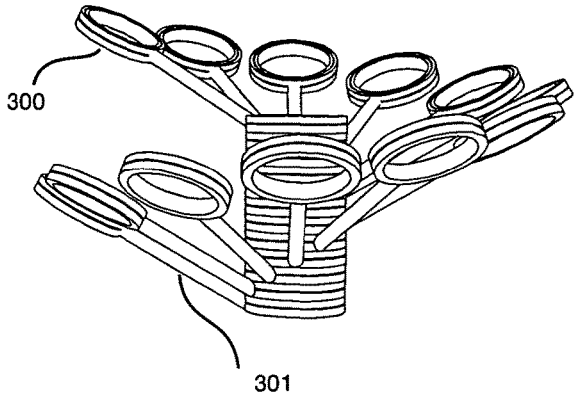
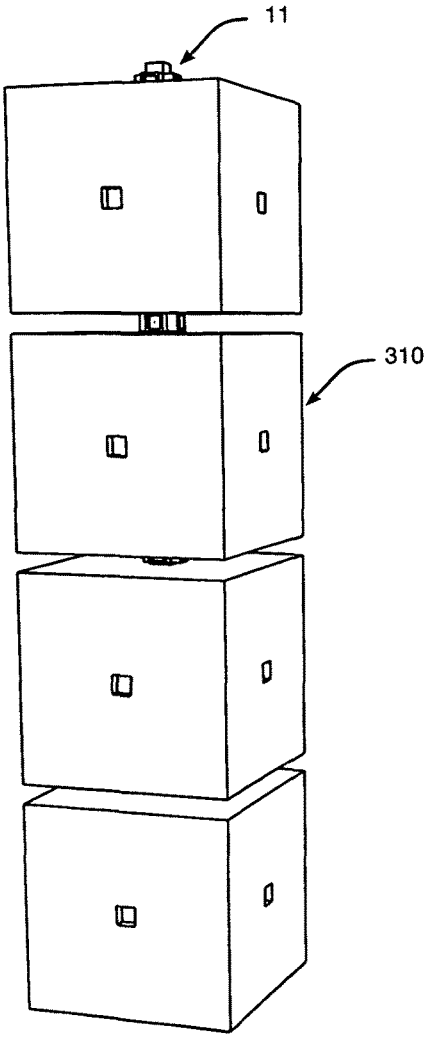
Fig. 31
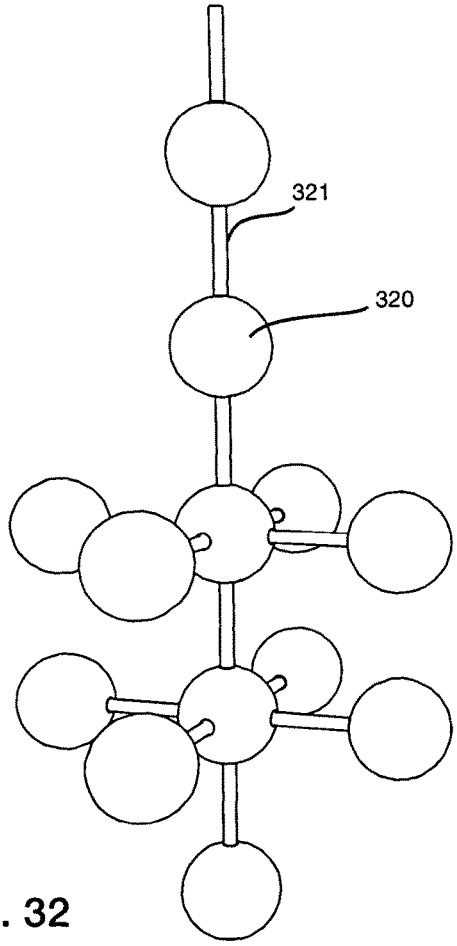
Fig. 32

MODULAR LIGHTING SYSTEM

CROSS-REFERENCE TO RELATED APPLICATIONS

The present application claims priority to U.S. Provisional Patent Application No. 62/123,682 filed Nov. 24, 2014 and U.S. Provisional Patent Application No. 62/283,792 filed Sep. 12, 2015, the disclosures of which are incorporated by reference herein in their entirety.

TECHNICAL FIELD

The present invention relates to lighting systems, and more particularly to modular lighting systems of a type wherein illuminating modules can be detachably interconnected, either directly or indirectly, creating two and three-dimensional lighting assemblies in a structurally self-supporting manner that can be reconfigured without the need for tools or technical skills in the field by an end user.

BACKGROUND ART

The brightness of indoor space often needs adjustment in order to adapt to different lighting needs due to the functional change of the space or color and reflectivity of different finish materials. It is known in the prior art to alter the illumination level of a space. Movable light fixtures, such as desk or floor lamps, or fixed light fixtures, such as ceiling/wall mount fixtures, can be added or changed. However, these solutions provide limited amount of change in illumination level and often the effect is localized, or require the help of electricians.

As an alternative to the above methods, there are a few lighting devices which incorporate the idea of lighting units that can be added or removed to alter the illumination level. Proposed lighting devices could be also useful for their general illumination purposes, but they are more suitable for the applications where their decorative or other functional purposes are intended. For example, there are disclosures which use reconfigurable lighting modules such as modular lighting tubes (U.S. Pat. No. 7,217,023, U.S. Pat. Appl. Publ. No. 2012/0201021 and U.S. Pat. No. 4,581,687), or modular lighting tiles (US Pat. Appl. Publ. No. 2012/0224373), but their specific geometry of module limits the module's connectivity and possible assembly configurations. Moreover, the disclosures above are intended to be used as other architectural elements rather than general illumination devices (U.S. Pat. No. 4,581,687 and US Pat. Appl. Publ. No. 2012/0224373). The light source of the prior art above is located only at the end (U.S. Pat. No. 7,217,023), or only in front or back (US Pat. Appl. Publ. No. 2012/0201021 and US Pat. Appl. Publ. No. 2012/0224373), providing directional illumination and causing shaded spots or non-illuminated areas within the fixture. Furthermore, in each disclosure, modules may be connected to one another in a single connection method. In one method, they are directly connected to one another with male/female fasteners (U.S. Pat. No. 4,581,687) or magnets (US Pat. Appl. Publ. No. 2012/0224373). When using a fastener, due to the fact that each fastener accommodates only one other module and the fastener is attached to each end of the tube, the connection pattern is predominantly two dimensional and linear with limited number of possible configurations (U.S. Pat. No. 4,581,687). For this particular disclosure, a one-to-one connection was intended to achieve the appearance of a continuous line of fixtures with apparent seamless joints. Lighting tiles with magnets on the edges can accommodate direct connection of four modules on all sides, but the connection pattern only allows for two-dimensional surface applications (US Pat. Appl. Publ. No. 2012/0224373). Alternatively, modules are connected indirectly via distinct connectors with additional end cap, locking rings and a spacer (US Pat. Appl. Publ. No. 2012/0201021). In this case, depending on the intended shape of assembly and number of modules to be connected, connectors with specific shapes with specific number of sockets/sleeves (US Pat. Appl. Publ. No. 2012/0201021 and U.S. Pat. No. 7,217,023) are required. Therefore, the freedom of reconfiguration is limited within the number of different connectors in use. Due to the specific connectors required for the predetermined connection pattern and many connection elements required, the connection system becomes complicated and non-illuminated connectors make up a significant part of the assembly, as they are bigger than the tubes in diameter, and bulkier.

Other known prior art that uses the system of lighting modules are illuminated modular blocks (U.S. Pat. Nos. 7,731,558 and 7,322,873), daisy chain LEDs and track lights. Modular blocks are designed to be a set of toys. They are not intended to provide general illumination with their singular light source, but designed to have a blinking and glowing effect. Due to the exposed male and female conductors or a plurality of magnetic fasteners on each surface of the block, significant amount of each surface cannot be illuminated or is obscured. Furthermore, when two blocks are connected, at least two surfaces of the blocks are entirely obscured as they are attached together, which is worsened with each connected block. The alternate embodiment of U.S. Pat. No. 7,322,873, an illuminated toy system consisting of illuminating ball and connector stick uses distinct connectors and spherical lighting modules with a plurality of connecting apertures. Due to the non-illuminated connecting apertures and conducting connectors occupying a large portion of the surface area and volume of the module shell, significant amount of the module's surface is obscured or cannot be illuminated, and creates uneven lighting. Daisy chain LEDs are structurally dependent on the mounted surface for accent or supplemental lighting, allowing for only end-to-end connection. Track lights allow for altering the number of fixtures, but on a predetermined linear path, therefore its flexibility in application is limited within the length and shape of the track.

SUMMARY OF THE EMBODIMENTS

In a first embodiment of the invention, there is provided an illuminating module containing a light source and mechanical and electrical connectors in a protective light-transmissive shell, and typically includes structural supports, wiring, controlling electronics and thermal dissipation. In this embodiment, the connecting area of the illuminating module mechanically and electrically connects one or more distinct intermediate connectors, to which other similar illuminating modules are connected. The intermediate connectors may be of various shapes to allow for illuminating modules to be connected in various attachment positions and angles, creating variable two and three-dimensional connection patterns, while allowing for thermal conductivity away from the modules.

In a related embodiment, a similar illuminating module may alternatively include at least one integrated connector within the assembly. In this embodiment, the integrated connector enables each illuminating module to be mechanically and electrically connected directly to one or more similar illuminating modules. By altering the number of illuminating modules used and the way they are connected, the level of illumination and the shape of the assembly can be changed with each connection increasing the possible number of connections and possible variations in forms.

Within both modular lighting systems, one or more illuminating modules are detachably connected to one or more power connectors, which may be mounted to or within a wall, ceiling, floor or placed freely on a surface, corresponding to the lighting needs. The modular lighting system may also contain internal batteries.

In accordance with one embodiment of the invention, a modular lighting system includes a set of interconnected reconfigurable illuminating modules and corresponding intermediate connectors. Each illuminating module includes a light source and at least one connecting area. Each connecting area includes an illuminating module coupling assembly having at least one ferromagnetic member and having electrically conductive members electrically coupled to the light source. Each intermediate connector has a plurality of intermediate connector coupling assemblies electrically coupled to one another. Each intermediate connector coupling assembly includes a ferromagnetic component that is configured to be magnetically coupled with the ferromagnetic member so that one intermediate connector coupling assembly is electrically coupled to one illuminating module coupling assembly, and the two coupling assemblies are held in electrical contact with one another by magnetic force.

In accordance with another embodiment of the invention, a reconfigurable illuminating module includes a light source and at least one connecting area. The illuminating module is configured to connect with a corresponding intermediate connector having a plurality of intermediate connector coupling assemblies, with each intermediate connector coupling assembly including a ferromagnetic component. Each connecting area includes an illuminating module coupling assembly having at least one ferromagnetic member and having electrically conductive members electrically coupled to the light source. The ferromagnetic member is configured to be magnetically coupled with the ferromagnetic component in one of the plurality of intermediate connector coupling assemblies so that one illuminating module coupling assembly is electrically coupled to one intermediate connector coupling assembly and is held in electrical contact with the intermediate connector coupling assembly by magnetic force.

In accordance with another embodiment of the invention, a method of forming a lighting system includes forming at least one illuminating module that includes a light source and at least one connecting area, each connecting area including an illuminating module coupling assembly having at least one ferromagnetic member and having electrically conductive members electrically coupled to the light source, and forming at least one intermediate connector that has a plurality of intermediate connector coupling assemblies electrically coupled to one another. Each intermediate connector coupling assembly includes a ferromagnetic component that is configured to be magnetically coupled with the at least one ferromagnetic member so that one intermediate connector coupling assembly is electrically coupled to one illuminating module coupling assembly. The illuminating module coupling assembly is configured to be coupled to the intermediate connector coupling assembly so that the two assemblies are held in electrical contact with one another by magnetic force.

In related embodiments, each illuminating module may include a light-transmissive exterior shell, and the light source may be disposed within the shell and the at least one connecting area may be formed in a portion of the shell. The intermediate connector coupling assembly may be further coupled to the illuminating module coupling assembly with a mechanical fastening system configured to provide additional resistance to rotational forces, bending forces, shear forces, and/or tension forces. The light source may include a core surrounded by light-emitting diodes (LEDs), and the core may be configured to provide structural support to, and act as a heat sink to, the LEDs. The core may include carbon fiber. The system may further include a power connector configured to be coupled to a power source and configured to be coupled to the illuminating module coupling assembly or the intermediate connector coupling assembly in order to provide electrical power to the illuminating modules. The system may further include a non-powered connector configured to be coupled to a ceiling, wall or floor and configured to be coupled to the illuminating module coupling assembly or the intermediate connector coupling assembly in order to provide structural support to the illuminating modules. The ferromagnetic member may be one of the electrically conductive members electrically coupled to the light source. The plurality of intermediate connector coupling assemblies, of a selected one of the intermediate connectors, may be mounted in the selected intermediate connector, so that an insertion axis of any given one of the coupling assemblies is mounted in a fixed relationship to insertion axes of the other intermediate connector coupling assemblies of the selected one of the intermediate connectors. At least one of the intermediate connectors may be a fixed intermediate connector configured to provide fixed connection angles with the corresponding illuminating module. Each of the plurality of intermediate connector coupling assemblies, of a selected one of the intermediate connectors, may be adjustably mounted in the selected intermediate connector, so that an insertion axis of such coupling assembly can be oriented in a desired relationship to insertion axes of the other intermediate connector coupling assemblies of the selected one of the intermediate connectors. At least one of the intermediate connectors may be an adjustable intermediate connector configured to provide variable connection angles with the corresponding illuminating module.

In accordance with another embodiment of the invention, a reconfigurable illuminating module, for use in a lighting system that includes a set of reconfigurable illuminating modules, includes a light source having a core, a set of light-emitting diodes (LEDs) surrounding the core, wherein the core is configured to provide structural support to, and act as a heat sink to, the LEDs, a light-transmissive exterior shell, and at least one connecting area formed in the shell. The light source is disposed within the shell and coupled electrically to local first conductive members in each of the connecting areas. Each connecting area is configured to removably receive second electrically conductive members, in an assembly that is removably attachable to the shell and electrically and mechanically coupled to a second illuminating module, and corresponding ones of the first and second conductive members are electrically coupled when a selected one of the connecting areas has received the second members in the assembly.

In related embodiments, the assembly may include an intermediate connector that is removably coupled to the second illuminating module. The assembly may be integrally formed in the second illuminating module. The second electrically conductive members may include a female terminal and a male terminal configured to couple with a corresponding male terminal and female terminal in the local first conductive members. The female terminal of the second electrically conductive members and the female terminal of the local first conductive members may have a toroidal shape configured to receive the respective male terminals in a center thereof. The assembly may include at least one adjustable intermediate connector that is removably coupled to the second illuminating module. The at least one adjustable intermediate connector may be ring-shaped and configured to provide variable connection angles between the illuminating module and the second illuminating module and allows for one illuminating module to connect to multiple intermediate connectors at one connecting area.

BRIEF DESCRIPTION OF THE DRAWINGS

The foregoing features of embodiments will be more readily understood by reference to the following detailed description, taken with reference to the accompanying drawings, in which:

FIG. 13A shows a perspective view of an LED PCB as a light source, and FIG. 13B shows a perspective view of the LED PCB of FIG. 13A wrapped around a core in accordance with an embodiment of the present invention.

FIGS. 14 and 15 show a cross-sectional view through an intermediate connector with two independent metal plated surfaces and ferromagnetic conductors embedded in each connecting arm in accordance with an embodiment of the present invention.

FIG. 16 shows a perspective view of an intermediate connector that allows for an adjustable angle connection in accordance with an embodiment of the present invention.

FIG. 17A shows a perspective view of an illuminating module with an adjustable integrated connector, FIG. 17B shows a perspective view of the illuminating module of FIG. 17A connected to one similar illuminating module, FIGS. 17C and 17D show perspective views of the illuminating module of FIG. 17A connected to two similar illuminating modules, and FIG. 17E shows a perspective view of the illuminating module of FIG. 17A connected to three similar illuminating module in accordance with an embodiment of the present invention.

FIG. 18 shows an exploded perspective view of an illuminating module with an adjustable integrated connector in accordance with an embodiment of the present invention.

FIG. 30 shows a perspective view of a loop shape of illuminating modules with intermediate connectors in accordance with an embodiment of the present invention.

FIG. 31 shows a perspective view of cube shaped illuminating modules and fixed intermediate connectors in accordance with an embodiment of the present invention.

FIG. 32 shows a perspective view of sphere shaped illuminating modules with cylindrical fixed intermediate connectors in accordance with an embodiment of the present invention.

DETAILED DESCRIPTION OF SPECIFIC EMBODIMENTS

Figure 1:
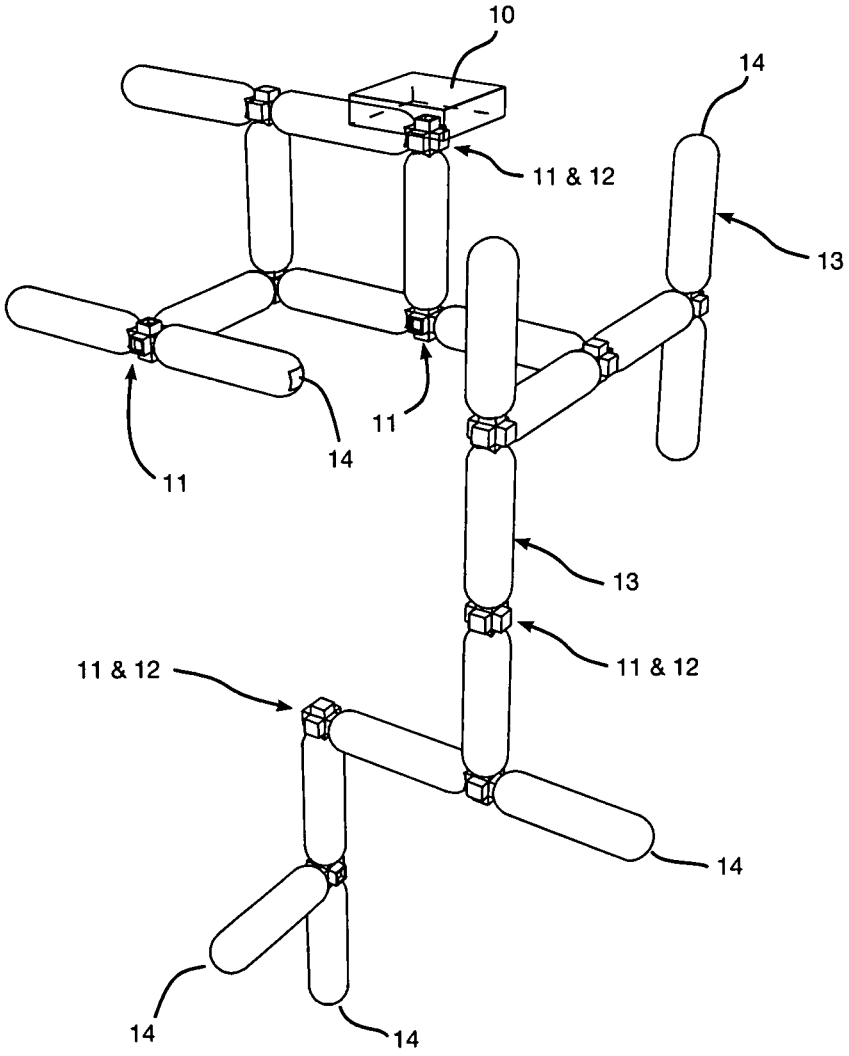
FIG. 1 shows a perspective view of an assembly of illuminating modules with fixed intermediate connectors suspended from the ceiling in accordance with an embodiment of the present invention.

Definitions. As used in this description and the accompanying claims, the following terms shall have the meanings indicated, unless the context otherwise requires:

A "modular lighting system" means a system of mechanically and electrically interconnected illuminating modules that are connected to one or more power connectors installed or suspended from a ceiling, floor, or walls for decorative or general illumination and whose form and illumination level can be adjusted by rearranging the modules without the need for tools and technical skills.

"General illumination" means the amount of light sufficient for illuminating work surfaces to allow for performing common work tasks, e.g., often cited as 40 foot-candles at the work surface.

An "illuminating module" means an assembly of parts including a light source, electrical conductors and fasteners in a protective light-transmissive shell, and typically includes structural supports, wiring, controlling electronics and thermal dissipation paths combined into an integrated unit. An illuminating module is powered from either an internal power source, such as batteries, or an external power source via a power connector.

A "light source" means an electrically powered illumination source, such as a light-emitting diode (LED), that may be mounted independently or to a rigid or deformable printed circuit board (P.C.B.).

An "integrated unit" means an assembly of parts that support primarily a single function and appears as a single element, has the appearance of a unified whole and whose parts cannot be removed without altering the function of the assembly.

An "integrated connector" is an integral part of an illuminating module that directly connects two or more illuminating modules mechanically and electrically at either fixed or adjustable angles, or to a power source.

An "intermediate connector" is a distinct device that mechanically and electrically connects one or more illuminating modules at their connecting areas, at either fixed or adjustable angles, to other similar illuminating modules, or a power source.

A "connecting area" is a part of an illuminating module where one or more intermediate connectors mechanically and electrically connect to provide power and structural support to the illuminating module and may provide thermal conductivity from the illuminating modules.

A "connecting face" is a part of intermediate connectors where one or more illuminating modules mechanically and electrically connect to provide power and structural support to the illuminating module.

A "connecting arm" means the male connecting area of an intermediate connector or a power connector.

A "power connector" provides an anchor that mechanically supports an illuminating module assembly and provides sufficient power to illuminate a modular lighting system.

"Electrically connected" means capable of transmitting electrical power and/or signal between or across illuminating modules, power connectors, intermediate connectors and integrated connectors.

"Mechanically connected" means components rigidly fastened to one another with sufficient strength that a direct applied force is required for separation of the components from one another, and capable of functioning as a structural whole. Such connections can be made magnetically, with friction, clips, screws and other standard fastening devices.

"Magnetically coupled" means having a mechanical connection wherein two ferromagnetic materials are magnetically attracted to each other.

A "set" includes at least one member.

"Resiliently deformable" means capable of deforming under a load, but returning to its original position or shape when the load is removed.

A "hotspot" is an area of high intensity light that remains visible through a light diffuser.

Embodiments of the present invention provide interconnected, reconfigurable illuminating modules with corresponding connectors. Embodiments show and describe two categories of illuminating modules, those with intermediate connectors (FIGS. 1-16 and FIGS. 22-32) and those with integrated connectors (FIGS. 17-21). Intermediate connector sits between illuminating modules, allowing connecting pattern between illuminating modules in all directions, with either fixed (FIGS. 1-15 and FIGS. 25-32) or variable positions (FIGS. 16 and 22-24). Connectors and illuminating modules can take on many unique forms (e.g., FIGS. 25-32). Alternatively, integrated connectors allow for an illuminating module to be directly connected to other illuminating modules without secondary elements at either an adjustable angle connection (FIGS. 17-21) or a fixed angle connection. Furthermore, both types of connection, integrated connectors and intermediate connectors, can be incorporated into a single illuminating module. Intermediate connectors and integrated connectors are internally electrically connected. In addition, the illuminating module's connecting areas are internally electrically connected. Details of illustrative embodiments are discussed below.

FIG. 1 is a perspective view showing an assembly of interconnected illuminating modules 13 with fixed intermediate connectors 11 suspended from a single ceiling power connector 10, shown transparent for clarity. The power connector 10 can have an integrated or remote power supply and regulation. Each exposed connecting area of illuminating modules 13 may have a safety cover 14 and each exposed face of intermediate connectors 11 may have a safety cover 12.

Figure 2:
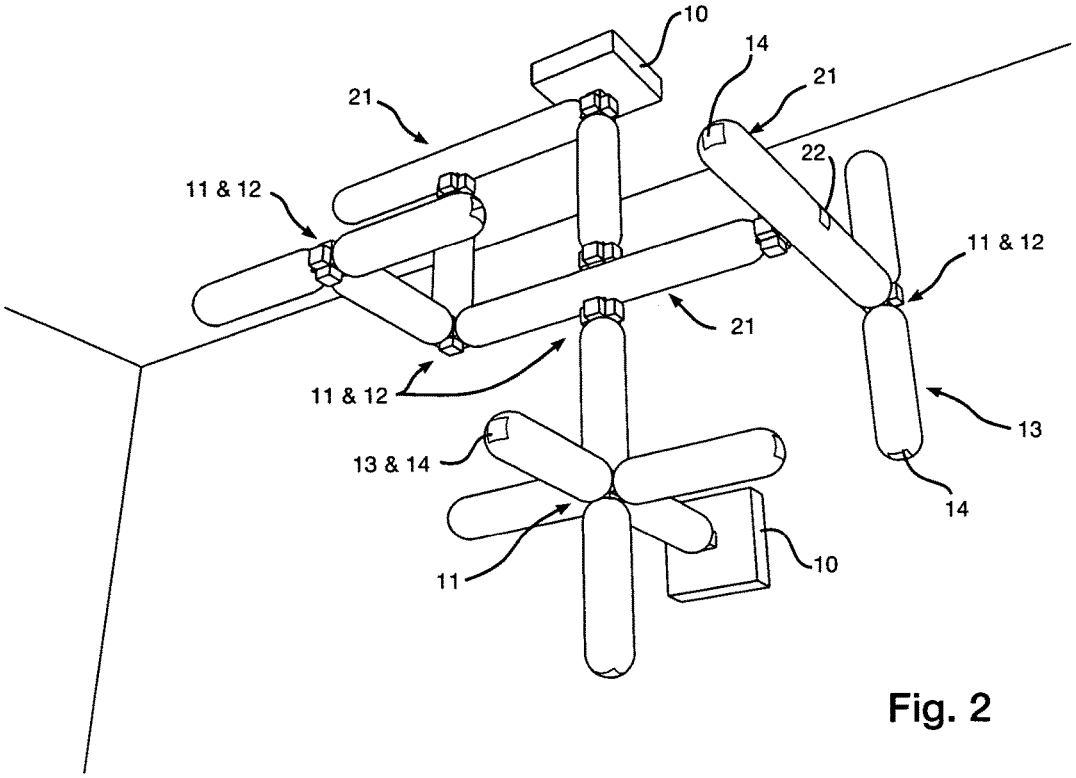
FIG. 2 shows a perspective view of an assembly of two different illuminating modules with fixed intermediate connectors mounted on the ceiling and the wall in accordance with an embodiment of the present invention.

FIG. 2 is a perspective view looking up at a ceiling showing an assembly of interconnected illuminating modules 13 and 21 with fixed intermediate connectors 11 suspended from both a ceiling and wall power connectors 10 for an expansive assembly. Illuminating modules 21 with four connecting areas are used in addition to illuminating modules 13 with two connecting areas to create three dimensional forms, although illuminating modules 13, 21 may have one or more connecting areas located in various positions. The intermediate connectors 11 maintain a uniform distance between the illuminating modules. Each exposed connecting area of illuminating modules may have a safety cover 14 and 22 and each exposed arm of intermediate connectors may have a safety cover 12. Although two connectors 10 are shown in FIG. 2, two or more connectors 10 may also be used with the assembly. In addition, the wall and ceiling connectors 10 are described as powered connectors, but one or more of the connectors 10 may be a non-powered connector coupled to the wall, ceiling, and/or floor that provides structural support to the lighting assembly without providing power to the illuminating modules 13, 21 and/or the intermediate connectors 11.

Figure 3:
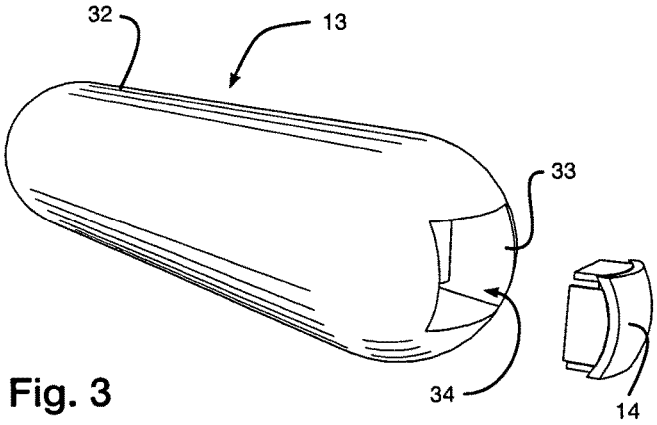
FIG. 3 shows one illuminating module with connecting areas and safety covers which accepts fixed intermediate connectors in accordance with an embodiment of the present invention.
Figure 4:
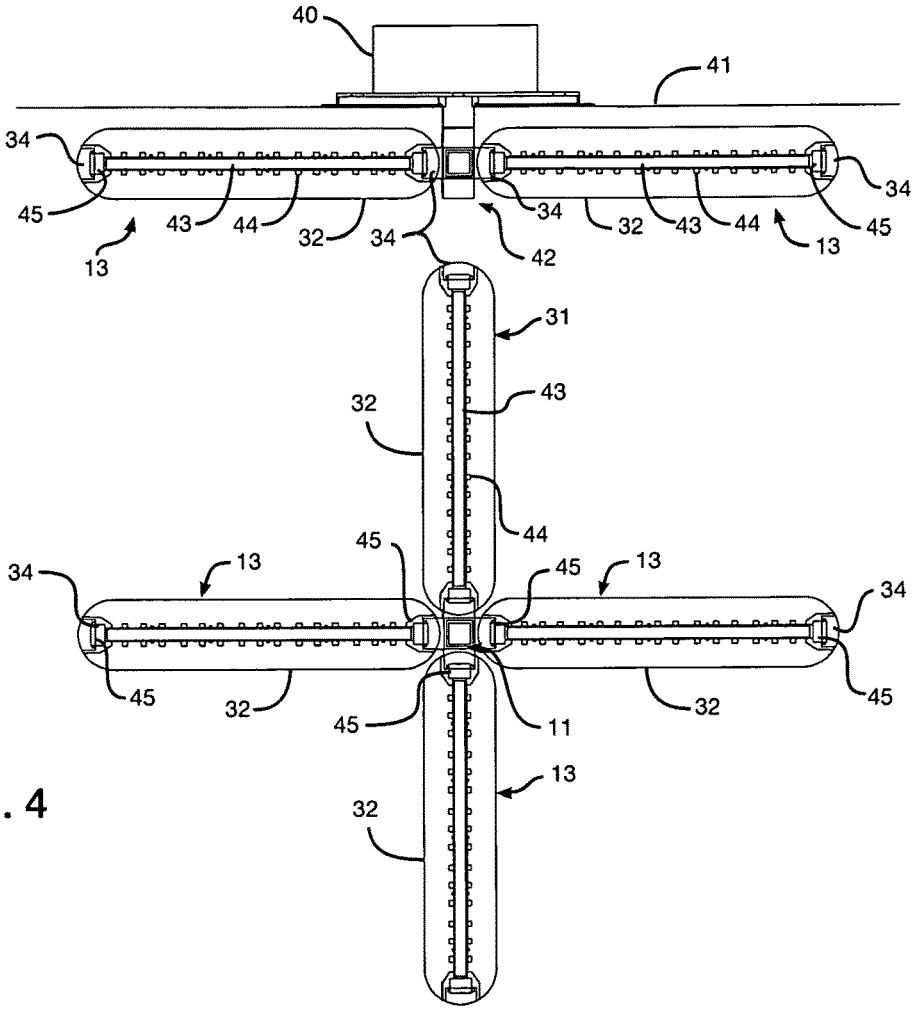
FIG. 4 shows illuminating modules with fixed intermediate connectors with a portion of the illuminating module protective shell removed to show the inner structure and connections in accordance with an embodiment of the present invention.

FIG. 3 is a perspective view of a fully assembled illuminating module 13 which accepts the fixed intermediate connector 11, showing the protective light-transmissive shell 32, that encompasses the entire illuminating module apart from the recess for the connecting area 34 that incorporates a collar 45 (shown in FIG. 4). For exposed connecting areas, safety cover 14 may be used for protection and fastens magnetically and/or by mechanical means. The light-transmissive shell 32 may be formed of a light emitting material such a OLED sheets or electroluminescent material, and may contain masked areas, that allows the transmitted light to appear non-white or patterned. The light-transmissive shell 32 may be formed of a light-weight plastic material, which is non-conductive. Alternatively, or in addition, the light-transmissive shell 32 may be coated with a conductive material to allow electrical connection to the connecting areas 34 through the coating.

FIG. 4 shows illuminating modules 13 with fixed angle intermediate connectors 11 with a portion of protective light-transmissive shell 32 removed to show its inner structure and connections. The recessed ceiling mounted power source 40 sits above the ceiling plane 41 leaving only the power connector 42 exposed. On the illuminating module 13, the connecting area 34 supports the device and provides power to the light source 44. The light source 44 is supported on core 43, which is held in place by collar 45. The exterior of the illuminating module 13 is a protective light-transmissive shell 32 and held by connecting area 34. Intermediate connector 11 connects illuminating modules 13 at their connecting areas 34.

Figure 5:
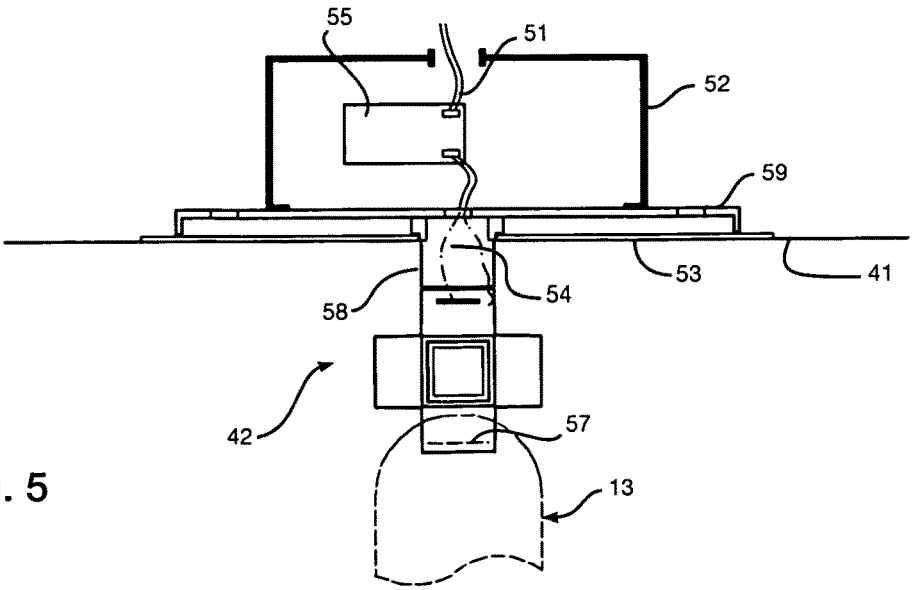
FIG. 5 shows a detailed view of a power connector and its connected power source shown in FIG. 4 in accordance with an embodiment of the present invention.

FIG. 5 shows a detailed view of a recessed ceiling mounted power source 40 (shown in FIG. 4) for power connector 42 which connects to illuminating module 13. The form of the power connector 42 is as found on the intermediate connector 11. Each connecting arm of power connector 42 and intermediate connector 11 has a peripheral conducting case and a central ferromagnetic conductor 57 which provides a mechanical and electrical connection. The connector 58 is fastened to a back plate 59 and electrically supplies power, herein shown as low voltage, via wires 54 from a transformer 55 that may be located within the ceiling junction box 52, to power connector 42. A removable protective plate 53 fits over the connector 58 and is held against the back plate 59. The transformer 55 is fed power via an electrical cable 51. The light source 44 within the attached illuminating module 13, 21 can be configured to work without a transformer, but one is preferred for safety.

Figure 6:
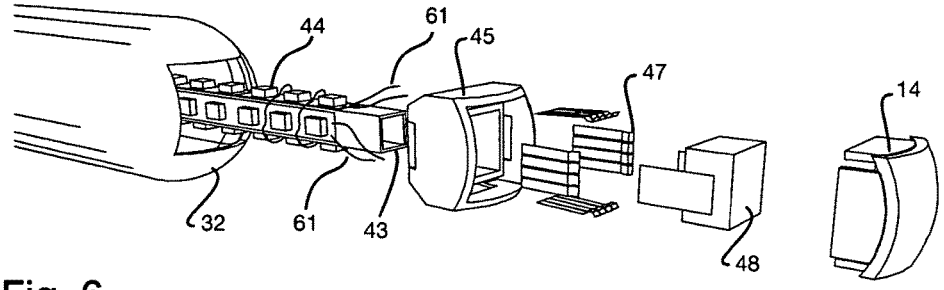
FIG. 6 shows an exploded perspective view of an illuminating module with safety cover in accordance with another embodiment of the present invention.

FIG. 6 is an exploded perspective view showing the inside of an illuminating module 13, 21 which accepts intermediate connector 11. The central thin-walled core 43, e.g., formed from aluminum or carbon fiber, serves as a structural support and heat sink for the light source 44, herein shown as a LED tape which is attached to each surface of core 43. Altering the diameter of core 43 and the number of its major sides, and alternatively the number of LEDs on the core 43, allows for the adjustment of module's brightness and light distribution. Core 43 connects to collar 45, which electrically connects the light source 44 to perimeter conductor 47 and a central conductor 48. The conductors 47, 48 and LED assembly 43, 44 are held in a fixed position by the collar 45 which supports and is enclosed by a protective light-transmissive shell 32. Each connecting area of the module 13, 21 contains the same arrangement and is electrically continuous.

Figure 7:
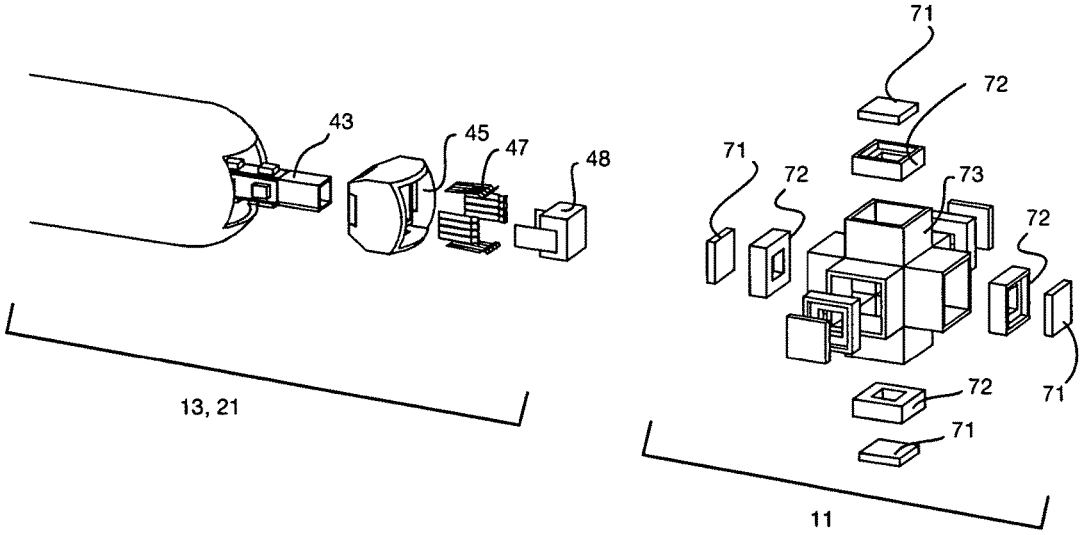
FIG. 7 shows an exploded perspective view of an illuminating module and the corresponding fixed integrated connector in accordance with an embodiment of the present invention.

FIG. 7 is an exploded perspective view showing one connecting area 34 of an illuminating module 13, 21 with an intermediate connector 11. FIG. 7 shows the alignment and connection between connecting area 34, perimeter conductors 47 and magnetic central conductor 48 on the illuminating module 13, 21 corresponding to the ferromagnetic conductor core 71, insulator 72 and metal plated conductor case 73 on the intermediate connector 11. When the illuminating module 13, 21 includes two or more connecting areas 34, the connecting areas 34 may all be electrically connected to the light source 44 and core 43, providing electrical connection between all of the connecting areas 34 of the illumination module 13, 21.

Figure 8:
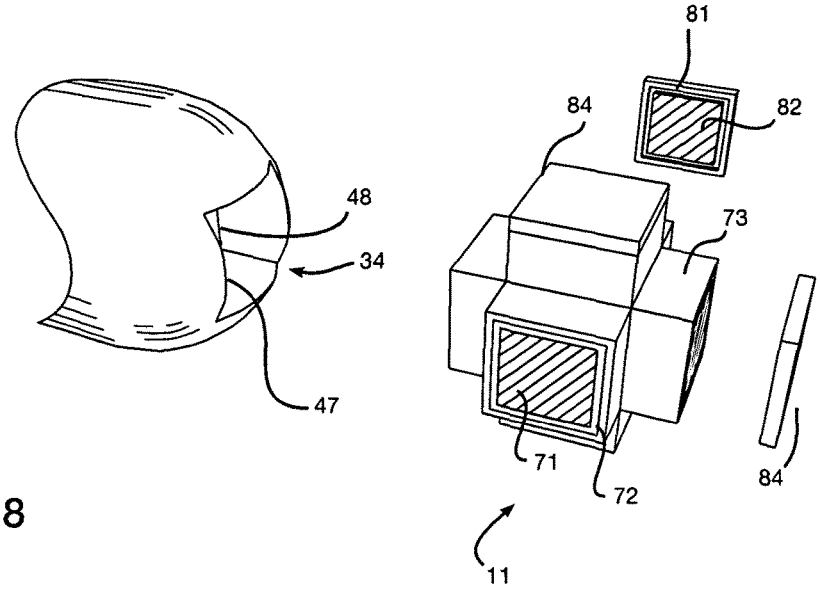
FIG. 8 shows a perspective view of a fixed intermediate connector and corresponding connecting area of an illuminating module in accordance with an embodiment of the present invention.

FIG. 8 shows a perspective view of the intermediate connector 11 and one connecting area 34 of an illuminating module 13, 21. Each connecting arm of intermediate connector 11 consists of a ferromagnetic conductor core 71 held by an insulator 72 which is contained within the intermediate connector's metal plated conductor case 73. The intermediate connector 11 is similar on all six arms, with all ferromagnetic conductor cores 71 electrically connected and all metal conductor cases 73 electrically connected. This configuration allows all arms of the intermediate connector 11 to be internally electrically connected. Although six arms are shown, two or more arms may be used. Ferromagnetic conductor core 71 couples to magnetic central conductor 48 on illuminating module 13, 21. Metal conductor case 73 electrically connects to perimeter conductors 47 on illuminating module 13, 21. The geometry of the connecting area 34 ensures a snug fit, limiting the connection's free movement. When the intermediate connector's arm is exposed, a safety cover 84 may be used for protection, which is held in place mechanically and/or via a magnetic pad 82.

Figure 9:
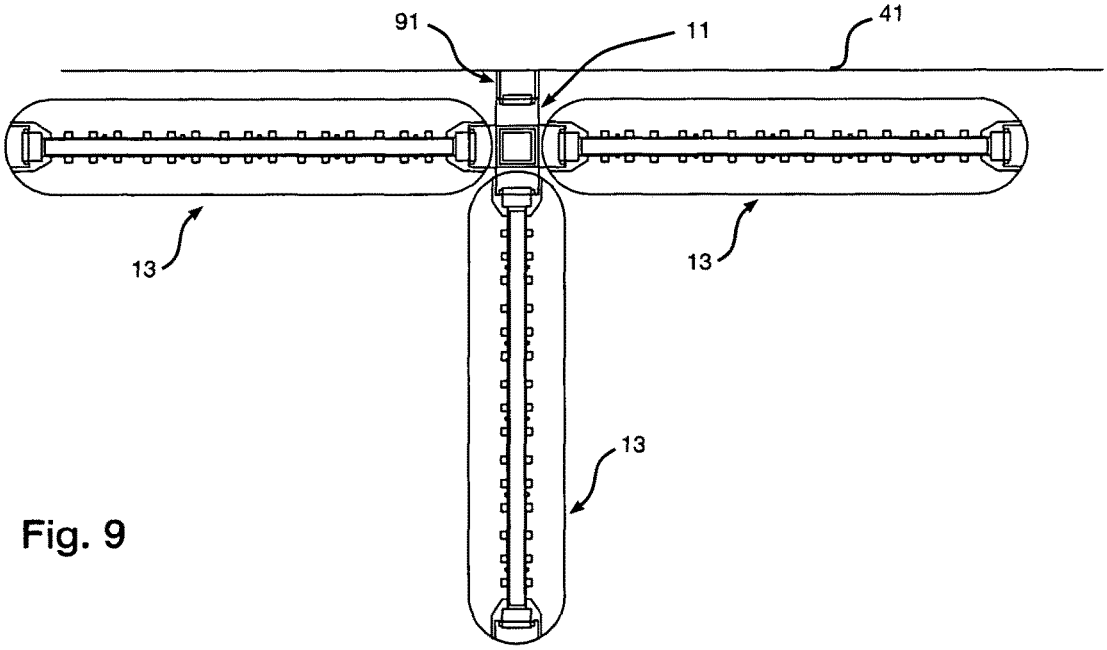
FIG. 9 shows a non-powered mechanical connector mounted on the ceiling plane supporting an intermediate connector and its corresponding illuminating modules with portions of the illuminating module protective shells removed to show the inner structure and connections in accordance with an embodiment of the present invention.

FIG. 9 shows non-powered mechanical mounting connector 91 mounted to a rigid surface 41, such as a ceiling or wall, which mechanically connects and supports intermediate connector 11 and assembly of illuminating modules 13, 21.

Figure 10:
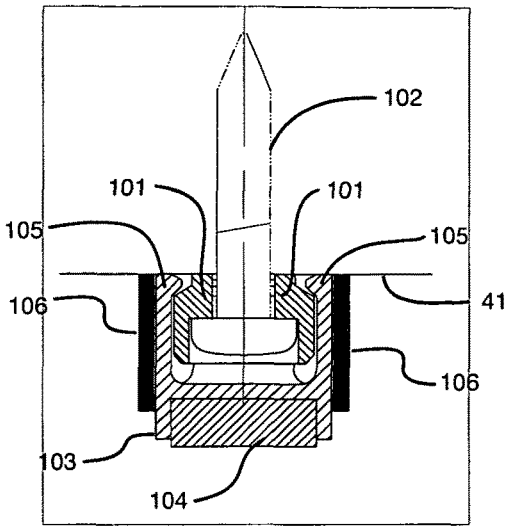
FIG. 10 shows a detailed view of a non-powered mechanical connector mounted on the ceiling plane shown in FIG. 9 in accordance with an embodiment of the present invention.

FIG. 10 shows a detailed view of connector 91, that includes a fastening plate 101 fastened to a rigid surface 41 with a mechanical fastener 102. A support 103 that rigidly holds a ferromagnetic member 104 is pushed onto the fastening plate 101 and is held in place by resiliently deformable arms 105. A locking ring 106 is pushed over fastening plate 101 and support 103 preventing the resiliently deformable arms 105 from flexing and thus releasing. The ring 106 is held in place by intermediate connector case 73 which is magnetically attracted to the mechanical mounting connector 91.

Figure 11:
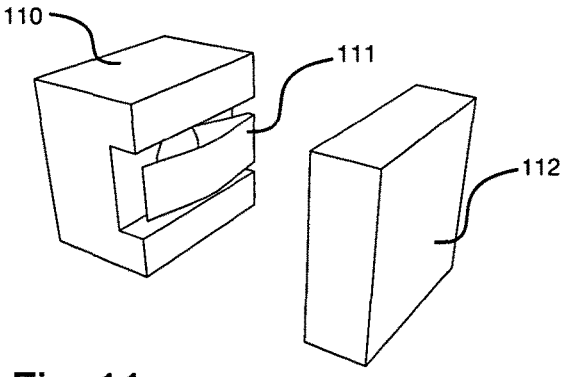
FIGS. 11 and 12 are perspective views showing a resiliently deformable contact fastened to a magnet in accordance with another embodiment of the present invention.
Figure 12:
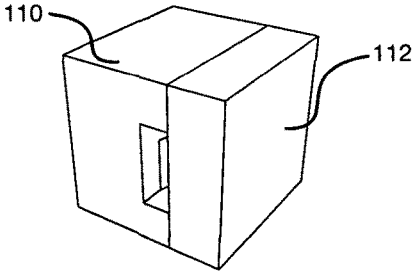

FIGS. 11 and 12 show a resiliently deformable contact 111 that is located within a magnet 110 and the mating ferromagnetic plate 112 from one of the central conductive pads as an alternate embodiment of the invention. FIG. 11 shows the resiliently deformable contact 111 and mating ferromagnetic plate 112 before being mated, and FIG. 12 shows the contact 111 and plate 112 after mating, where the resiliently deformable contact 111 comes into contact with the mating ferromagnetic plate 112 making a continuous electrical connection. The magnet 110 and the resiliently deformable contact 111 need not be electrically connected.

FIGS. 13A and 13B show LEDs 130, as a light source 44, fastened to a flexible PCB 131 that wraps around core 43 in accordance with another embodiment of the present invention. The PCB 131 is so arranged that when it wraps around core 43, the LEDs 130 of the PCB 131 are substantially aligned with a predetermined location of each surface of the core 43. The PCB 131 contains internal electrical paths and other components arranged to distribute electricity to each LED 130 and to the wire 61 on the PCB 131, herein shown at each end. The wire 61 fastens to the conductor 47, 48 within the collar 45, or may themselves form the conductor 47, 48 or part thereof.

FIGS. 14 and 15 are cross-sectional views showing intermediate connector 140 with ferromagnetic conductor pad 141 embedded in each connecting arm. The metal plated surface of the exterior conductor case 142 includes an inside surface 151 and outside surface 152 for electrical isolation, which are separated by a non-conductive gap 153 in accordance with another embodiment of the present invention. The arrangement shown in FIGS. 14 and 15 allows for the elimination of additional wiring within the intermediate connector 140, enabling faster assembly time.

FIG. 16 shows a perspective view of an intermediate connector 160, where each of the connector's face 161 may be rotated and angled to create multiple and varied angled connections, while maintaining electrical and mechanical connections across all faces. Each adjustable angle intermediate connector 160 contains a central supporting block 162, onto which a rotating coupling 163 is attached and is further attached to a hinge 164 that supports face 161. Face 161 consists of a magnetic conducting surface 165 and a spring loaded conductor pin 166 within a hole of the magnetic conducting surface 162 so that the spring loaded conductor pin 166 passes through and makes electrical connection with the illuminating module 13, 21 at the connecting area 34. The magnetic conducting surface 165 and the conductor pin 166 are electrically isolated and independently connected within the intermediate connector 160. It is clear that when such intermediate connector and corresponding illuminating module 13, 21 are connected, many variations of connection patterns and angles can be produced. Fixed and adjustable intermediate connectors may both be used within a single assembly.

FIGS. 17A through 17E show perspective views of an illuminating module 172 with an adjustable integrated connector 171 coupled to one, two or three similar illuminating modules 172, all without angular deflection. The figures also show alternate connection arrangements via a single terminal between illuminating modules 172.

Figure 19:
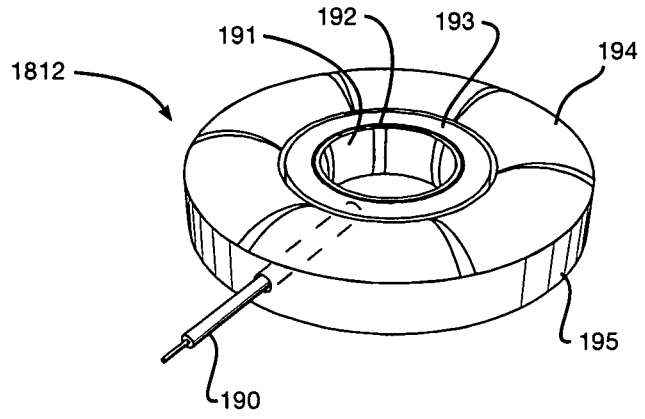
FIGS. 19, 20 and 21 show perspective views of an adjustable integrated connector's female terminal, male terminal, and male and female terminals assembled together, respectively, in accordance with an embodiment of the present invention.

FIG. 18 is an exploded perspective view showing the inside of an illuminating module 172 shown in FIG. 17A with an adjustable integrated connector 171. The protective light-transmissive shell 32 contains a central thin-walled core 182, e.g., formed from aluminum or carbon fiber, that serves as a structural support and heat sink for the light source 44 herein shown as a LED tape 183 which is wrapped around in a spiral pattern. The angle of the spiral can be adjusted to increase or decrease the wrapped length and thus the number of LEDs 184 within each module 172 and the module's brightness. Core 182 is held in place via a hollow tapered end stopper 185, which is attached to a circuit board 186. Electrical wires 61 connect the LED tape 183 to the circuit board 186. The circuit board 186 is held by integrated connector 171 and further connected electrically to the integrated connector 171 via compressible contacts 187. The circuit board 186 is electrically connected to the central terminals 1811 and 181 on connectors with insulated wires 61 which pass through the hinge 189 via a hole 1814. The circuit board 186 can connect to an internal battery (not shown) and can hold controlling logic and power controllers. The assembly is held together by a groove 188 at the perimeter of the integrated connector 171 clipping to the rim 181 of the protective light-transmissive shell 32. The integrated connector 171 freely rotates around rim 181 and contains an electrically conducting hinge 189 that mates with an electrically conducting pivoting arm 1813, providing mechanical stability for the male 1811 and female 1812 terminals. Terminal 1811 and 1812 are electrically continuous. Each adjustable integrated connector typically contains the same arrangement and is electrically continuous within a single illuminating module. FIG. 19 is a perspective view of a female terminal as shown in FIG. 18, item 1812. The female terminal 1812 provides mechanical support and electrical continuity via a central compressible contact ring 191, which is electrically connected to a circular conductor 192, which connects with an insulated wire 190 that passes through the body of the device 195 to the module's 172 internal electronics. The circular conductor 192 is held with an insulating ring 193, separating it from the conducting body 195. A series of compressible outer contacts 194 are mechanically and electrically connected to the integrated connector 171. Compressible conductors 191, 194 may be made of an electrically conductive material, e.g., beryllium copper. Compressible conductors 194 are located on both sides of the terminal.

Figure 20:
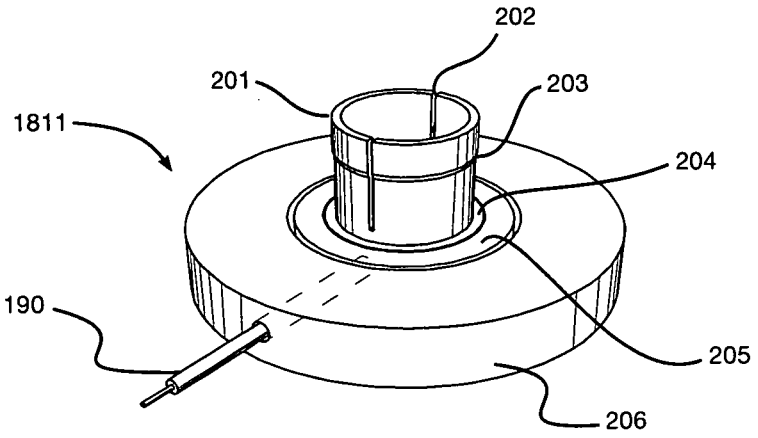

FIG. 20 is a perspective view of a male terminal as shown in FIG. 18, item 1811. The male terminal 1811 provides mechanical support and electrical continuity via a central compressible contact cylinder 201, into which relief cuts 202 allow the flared end above the ridge 203 of the cylinder 201 to be compressed when inserted into the female terminal 1812. The cylindrical conductor 201 connects to a contact ring 204, which connects to an insulated wire 61 that passes through the body of the device 206 to the module's 172 internal electronics. The contact ring 204 is held with an insulting ring 205, separating it from the conducting body 206. The compressible cylinder 201 may be made of an electrically conductive material, e.g., beryllium copper.

Figure 21:
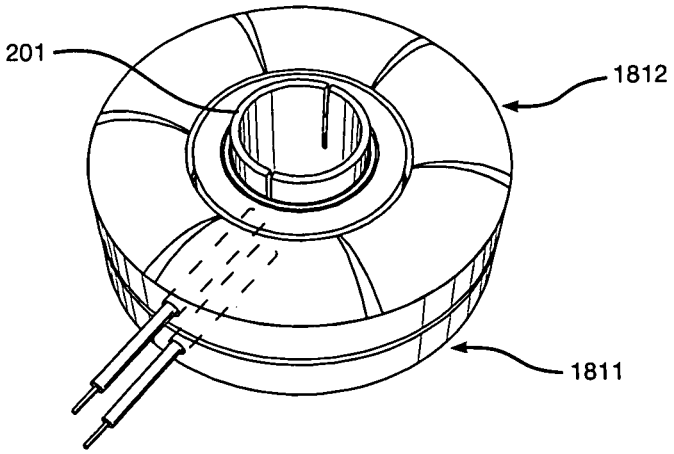

FIG. 21 is a perspective view of a coupled male 1811 and female 1812 terminal, showing the central compressible contact cylinder 201 from the male terminal 1811 extending past the top of the female terminal 1812 and compressing the female central compressible contacts 191 to ensure a secure electrical connection. The ridge of the central cylinder 201 pushes down on the female terminal 1812, compressing the outer contacts 194 to ensure a secure electrical connection. The overall connection allows rotation, but is mechanically robust and electrically continuous. The force required to separate the male 1811 and female 1812 terminals of the connector are dependent on the geometry of the compressible contacts cylinder 201 and the corresponding parts engaged on the opposing terminal.

Figure 22:
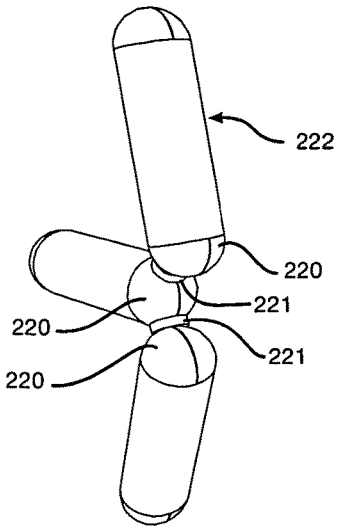
FIG. 22 shows a perspective view of illuminating modules connected with an adjustable intermediate connector with variable connection angles in accordance with an embodiment of the present invention.
Figure 23:
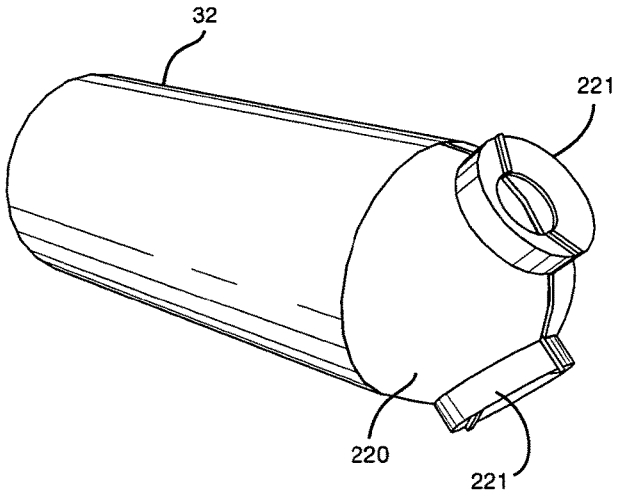
FIG. 23 shows a perspective view of an illuminating module with a corresponding adjustable intermediate connector shown in FIG. 22 in accordance with an embodiment of the present invention.
Figure 24:
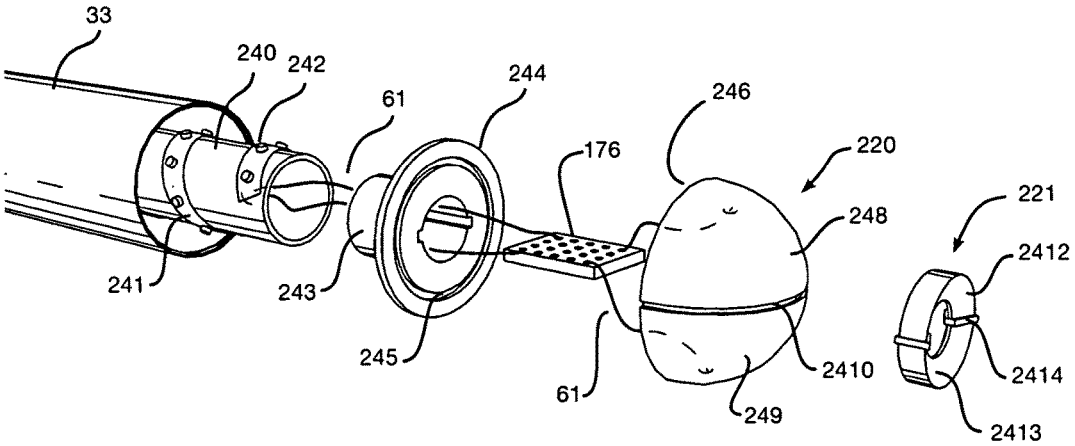
FIG. 24 shows an exploded perspective view of an illuminating module with a corresponding adjustable intermediate connector in accordance with an embodiment of the present invention.

FIG. 22 is a perspective view of illuminating modules 222 with adjustable intermediate connectors 221, further shown in FIGS. 23 and 24, showing a few possible configurations due to the rotatable connecting areas in dome shape 220 of the illuminating module 222 which allow for multiple connections to intermediate connectors 221 with variable angles concurrently.

FIG. 23 is a perspective view of a fully assembled illuminating module 222 with two intermediate connectors 221, showing the protective light-transmissive shell 32, a rotated connecting area 220 and the intermediate connectors 221 simultaneously fastened to connecting area 220.

FIG. 24 is an exploded perspective view showing the inside of an illuminating module 222 with intermediate connector 221. The protective light-transmissive shell 32 holds a central thin-walled core 240, e.g., formed from aluminum or carbon fiber, that serves as a structural support and heat sink for the light source 44, herein shown as a LED tape 241 which is wrapped around in a spiral pattern. The angle of the spiral can be adjusted to increase or decrease the wrapped length and thus the number of LEDs 242 within each illuminating module 222 and the module's brightness. Core 240 connects via a hollow tapered end stopper 243 to a circuit board 176 which fits inside the stopper 243. Wires 61 electrically connect the LEDs 242 to a circuit board 176 and optionally to an internal battery (not shown). The circuit board 176 can also hold controlling logic and power controllers. The stopper 243 flares to a ring 244 at one end which fastens to the lip of the protective light-transmissive shell 32 and holds the LED assembly 240, 241, 242 in a fixed position. The connecting area 220 forms a protruding circular ring 246 that clips into the recessed ring 245 on the stopper 243 and freely rotates. Wires 61 from the circuit board 176 pass inside the ring 246 and connect to each conducting surfaces 248, 249 on the connecting area 220. The connecting area 220 includes two electrically isolated ferromagnetic, electrically conducting surfaces which may be positive 248 and negative 249. The surfaces are joined by an electrically insulating material which is recessed from connecting area 220 forming a slot 2410. An intermediate connector 221 connected to the connecting area 220 may include two electrically isolated ferromagnetic partial rings, a positive 2412 and negative 2413 fastened together by an electrically insulating fin 2414. The insulating fin 2414 projects beyond the ring surface and engages the insulating slot 2410 on the connecting area 220, aligning each conducting side of the intermediate connector 221 with each conducting surface of the connecting area 220. The insulating fin 2414 and slot 2410 may be additionally arranged to clip together. Each connecting area 220 of a similar illuminating module 222 typically contains the same arrangement and is electrically continuous.

Figure 25:
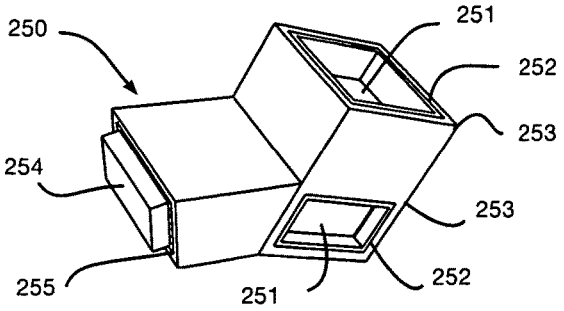
FIG. 25 shows a perspective view of an asymmetrical fixed intermediate connector in accordance with an embodiment of the present invention.

FIG. 25 is a perspective view of an asymmetrical intermediate connector 250, one of the variations of a fixed intermediate connector. Central conductor core 251 is electrically isolated from the metal conductor case 253 by an insulator 252. The intermediate connector 250 can fasten into an illuminating module 13, 21 or into another intermediate connector 11, 250 via the male arm where the central conductor core 254 is electrically isolated from the metal conductor case 256 by an insulator 255. Within the intermediate connector 250, all conductors are electrically connected to corresponding conductors in each arm.

Figure 26:
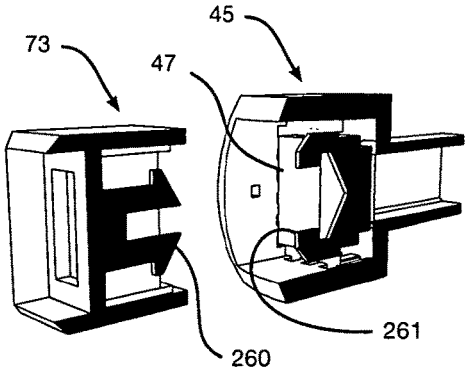
FIG. 26 shows a cross-sectional perspective view of one arm of a fixed intermediate connector with a push fit connection in accordance with an embodiment of the present invention.

FIG. 26 is a cross-sectional perspective view of one arm 73 of a fixed intermediate connector 11, 140, 250, 280, and corresponding collar 45 in an alternate arrangement where a push fit connection fastens the intermediate connector 11, 140, 250, 280 to the corresponding collar 45 in conjunction with, or instead of, a magnetic connection. When the parts are joined, deformable male connector 260 temporarily deforms and then expands into female connector 261 forming a releasably secure connection and contact 47 electrically connected to a corresponding contact in arm 73 (not shown). An additional electrical contact may be made using the conducting connecting arm 73 or may be formed with an addition pair of contacts and corresponding contact in arm 73. Due to the geometry of the male and female connectors 260, 261, more force is required to separate the connections than to form the connection.

Figure 27:
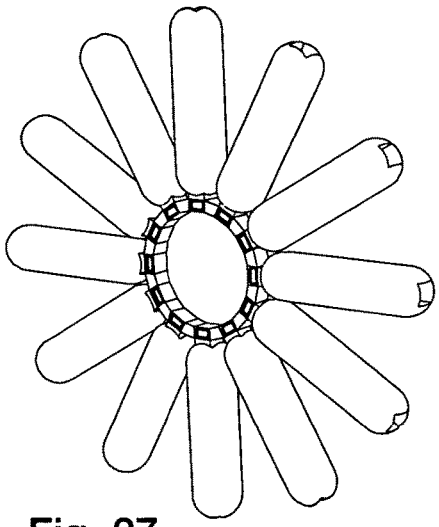
FIG. 27 shows a perspective view of illuminating modules with asymmetrical intermediate connectors arranged in geometric patterns in accordance with an embodiment of the present invention.

FIG. 27 is a perspective view of an asymmetrical intermediate connector 250 and corresponding illuminating modules 13, 21 arranged in a circular pattern.

Figure 28:
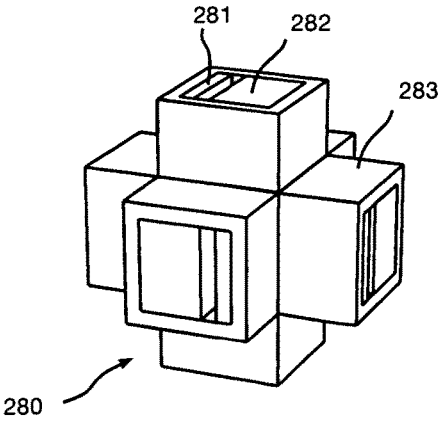
FIG. 28 shows a fixed intermediate connector with a different connection method in accordance with an embodiment of the present invention.

FIG. 28 shows a perspective view of an alternate design for a fixed intermediate connector 11 which is held in place with friction instead of, or in addition to, a magnetic connection. Intermediate connector 280 contains a cluster of paired conductor pins 281, 282, which are electrically isolated and held in position by the non-conducting case 283. All six faces of the connector 280 are similar and all conductor pins 281, 282 are electrically connected to corresponding pins in each face. Additional fastening methods, such as screw, clips, snaps and other common fasteners can be used instead of, or in conjunction with, connector 280 or connector 11.

Figure 29:
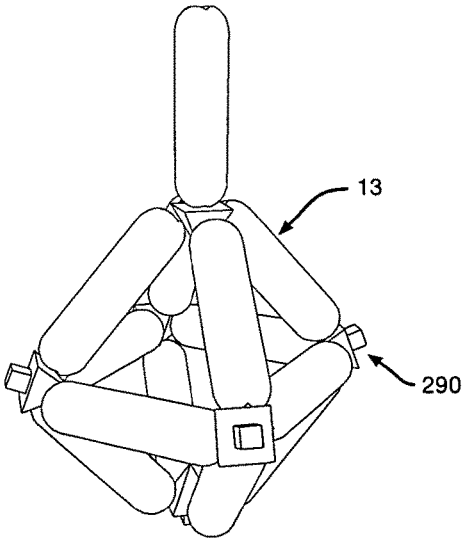
FIG. 29 shows a perspective view of illuminating modules arranged in an octahedron pattern in accordance with an embodiment of the present invention.

FIG. 29 is a perspective view of illuminating modules arranged in an octahedron pattern. The corresponding intermediate connector 290 contains similar features to the intermediate connector 250 shown in FIG. 25.

FIG. 30 shows an alternate loop shape of the illuminating modules 300 and their intermediate connectors 301 in a stacked, radial arrangement using one central ring with many intermediate connectors 301 connecting to peripheral illuminating modules 300.

FIG. 31 shows an alternate cube shape of illuminating modules 310 with fixed intermediate connectors 11.

FIG. 32 is a perspective view of an illuminating module 320 in a sphere shape with cylindrical intermediate connectors 321.

The embodiments herein described offer a number of advantages over prior art assemblies. First, the embodiments herein provide a new alternative to known methods of altering illumination level. Using the present embodiments, the brightness of a space can be increased or decreased simply by adding or removing illuminating modules, without technical skills or the help of specialists.

The typical components of lighting fixtures such as sockets, wiring and light sources are integrated within the physical body of an illuminating module as a single element. By integrating components, the need for external wires or bulbs is eliminated. Without wires, the lighting assembly can be rearranged or expanded easily as the lighting system consists of fewer and simpler elements than conventional fixtures.

The illuminating modules can hang from a ceiling, be attached as sconces to a wall, sit on desks or other surfaces, or have multiple connections between the wall, floor and ceilings, as needed for the intended design and illumination level. The illuminating modules can additionally contain (rechargeable) batteries. The brightness of the modules can also be controlled by changing the lumens of the light source selected or by conventional means, such as dimmers.

Fixtures are often selected for their aesthetic value. In this embodiment, modules can be arranged to suit individual end user's preference or needs and can be rearranged by the end user with or without change in illumination levels. Illuminating modules are designed to be connected together in a three dimensional form, with each connection increasing the possible number of additional connections and possible variations in forms.

It is possible to provide a control signal to each illuminating module (or to each light source within the module), either via the power conductors, additional wires, wirelessly or determined by the illuminating module itself, using such data as its own position, sequence, motion or other factors, allowing variations in brightness, color and flashing patterns.

The embodiments of the invention described above are intended to be merely exemplary; numerous variations and modifications will be apparent to those skilled in the art. All such variations and modifications are intended to be within the scope of the present invention as defined in any appended claims.

What is claimed is:

1. A lighting system comprising:

a set of interconnected reconfigurable illuminating modules and corresponding removably attachable intermediate connectors, wherein:

(i) each illuminating module includes:

a light source and a light-transmissive shell in which the light source is disposed, the shell having a recess, and an illuminating module coupling assembly disposed in the recess, the coupling assembly having a coupling member with a generally planar surface and having a set of electrically conductive lighting contacts electrically coupled to the light source, the coupling member being one of the conductive lighting contacts;

(ii) each intermediate connector includes a case with a plurality of hollow protrusions, each protrusion shaped to fit into the recess in the shell of each illuminating module, and each protrusion houses a corresponding intermediate connector coupling assembly, each coupling assembly including a coupling component having a generally planar contact face, the coupling assemblies being electrically coupled to one another and to a set of electrically conductive powering contacts, each contact face being one of the conductive powering contacts;

(iii) the coupling member of any given illuminating module is configured to be magnetically coupled to any given coupling component of a given one of the intermediate connectors under conditions wherein (i) the protrusion that houses the given coupling component has been placed into one of the recesses of the given illuminating module and (ii) the generally planar surface of the coupling member abuts the contact face of the given coupling component, the coupling member and the given coupling component being magnetic connection elements, wherein one of the magnetic connection elements is a magnet and the other magnetic connection element is ferromagnetic; and (iv) a connection between the given illuminating module and the given intermediate connector is formed when (a) the coupling member, of the given illuminating module, is magnetically coupled to the given coupling component and (b) the set of electrically conductive lighting contacts of the given illuminating module is electrically coupled to the set of electrically conductive powering contacts of the given intermediate connector coupling assembly.

2. A lighting system according to claim 1, wherein each illuminating module includes a light-transmissive exterior shell, wherein the light source is disposed within the shell and the at least one connecting area is formed in a portion of the shell.

3. A lighting system according to claim 1, wherein the intermediate connector coupling assembly is further coupled to the illuminating module coupling assembly with a mechanical fastening system configured to provide additional resistance to rotational forces, bending forces, shear forces, tension forces, or a combination thereof.

4. A lighting system according to claim 1, wherein the light source includes a core surrounded by light-emitting diodes (LEDs), wherein the core is configured to provide structural support to, and act as a heat sink to, the LEDs.

5. A lighting system according to claim 4, wherein the core comprises carbon fiber.

6. A lighting system according to claim 1, further comprising a power connector configured to be coupled to a power source and configured to be coupled to the illuminating module coupling assembly or the intermediate connector coupling assembly in order to provide electrical power to the illuminating modules.

7. A lighting system according to claim 1, further comprising a non-powered connector configured to be coupled to a ceiling or wall and configured to be coupled to (a) one of the illuminating module coupling assemblies or (b) one of the plurality of intermediate connector coupling assemblies in order to provide structural support to the illuminating modules.

8. A lighting system according to claim 1, wherein the coupling member is one of the electrically conductive lighting contacts electrically coupled to the light source.

9. A lighting system according to claim 1, wherein the plurality of intermediate connector coupling assemblies, of a selected one of the intermediate connectors, are mounted in the selected intermediate connector in orientations wherein an insertion axis of any given one of the coupling assemblies is in a fixed relationship to insertion axes of the other intermediate connector coupling assemblies of the selected one of the intermediate connectors.

10. A lighting system according to claim 1, wherein each of the plurality of intermediate connector coupling assemblies, of a selected one of the intermediate connectors, is adjustably mounted in the selected intermediate connector, so that an insertion axis of such coupling assembly can be oriented in a desired relationship to insertion axes of the other intermediate connector coupling assemblies of the selected one of the intermediate connectors.

11. A reconfigurable illuminating module configured to connect with a corresponding intermediate connector having a plurality of intermediate connector coupling assemblies, each intermediate connector coupling assembly including a case with a plurality of hollow protrusions, each protrusion housing a corresponding coupling component having a generally planar contact face, the illuminating module comprising:

a light source and a light-transmissive shell in which the light source is disposed, the shell having at least one recess shaped to receive one of the protrusions of a given one of the intermediate connector coupling assemblies; and at least one connecting area, each connecting area including an illuminating module coupling assembly disposed in one of the recesses and having a coupling member with a generally planar surface and having a set of electrically conductive lighting contacts electrically coupled to the light source, the coupling member being one of the conductive lighting contacts, the coupling member configured to be magnetically coupled to the given coupling component of a the corresponding intermediate connector, under conditions wherein (i) the protrusion that houses the given coupling component has been placed into one of the recesses of the illuminating module and (ii) the generally planar surface of the coupling member abuts the contact face of the given coupling component, the coupling member and the coupling component being magnetic connection elements wherein one of the magnetic connection elements is a magnet and the other magnetic connection element is ferromagnetic, wherein a connection between a given one of the illuminating modules and a specific one of the intermediate connectors is formed when (a) the coupling member the illuminating module, is magnetically coupled to the given coupling component of the corresponding intermediate connector coupling assembly and (b) the set of electrically conductive lighting contacts of the illuminating module is electrically coupled to the set of electrically conductive powering contacts of the corresponding intermediate connector coupling assembly.

12. A reconfigurable illuminating module according to claim 11, further comprising a light-transmissive exterior shell, wherein the light source is disposed within the shell and the at least one connecting area is formed in corresponding portions of the shell.

13. A reconfigurable illuminating module according to claim 11, wherein the light source includes a core surrounded by light-emitting diodes (LEDs), wherein the core is configured to provide structural support to, and act as a heat sink to, the LEDs.

14. A reconfigurable illuminating module according to claim 11, wherein the coupling member is one of the electrically conductive lighting contacts electrically coupled to the light source.

15. A lighting system according to claim 1, wherein the coupling component is ferromagnetic.

16. A method of forming a lighting system, the method comprising:

(i) forming at least one illuminating module that includes a light source and a light-transmissive shell in which the light source is disposed, the shell having a recess, and at least one connecting area, each connecting area including an illuminating module coupling assembly, disposed in the recess, having a coupling member with a generally planar surface and having a set of electrically conductive lighting contacts electrically coupled to the light source, the coupling member being one of the conductive lighting contacts;

(ii) forming at least one intermediate connector that includes a case with a plurality of hollow protrusions, each protrusion shaped to fit into the recess in the shell of each illuminating module, and each protrusion houses a corresponding intermediate connector coupling assembly, each coupling assembly including a coupling component having a generally planar contact face, the coupling assemblies being electrically coupled to one another and to a set of electrically conductive powering contacts, each contact face being one of the conductive powering contacts;

the coupling member of any given illuminating module being configured to be magnetically coupled to any given coupling component of a given one of the intermediate connectors, under conditions wherein (i) the protrusion that houses the given coupling component has been placed into the recess of the given illuminating module and (ii) the generally planar surface of the coupling member abuts the contact face of the given coupling component, the coupling member and the given coupling component being magnetic connection elements wherein one of the magnetic connection elements is a magnet and the other magnetic connection element is ferromagnetic; and (iii) forming a connection between the given one of the illuminating module and the given intermediate connector when (a) the coupling member, of the given illuminating module, is magnetically coupled to the given coupling component and (b) the set of electrically conductive lighting contacts of the given illuminating module is electrically coupled to the set of electrically conductive powering contacts of the given intermediate connector coupling assembly.

17. A method according to claim 16, wherein forming the at least one illuminating module includes forming the light source by providing a core and surrounding the core with light-emitting diodes (LEDs), wherein the core is configured to provide structural support to, and act as a heat sink to, the LEDs.

18. A method according to claim 16, further comprising providing a power connector configured to be coupled to a power source and configured to be coupled to (a) illuminating module coupling assemblies or (b) one of the plurality of intermediate connector coupling assemblies in order to provide electrical power to the at least one illuminating module.

19. A method according to claim 16, further comprising providing a non-powered connector configured to be coupled to a ceiling or wall and configured to be coupled to (a) one of the illuminating module coupling assemblies or (b) one of the plurality of intermediate connector coupling assemblies in order to provide structural support to the at least one illuminating module.

20. A method according to claim 16, wherein the coupling member forms one of the electrically conductive lighting contacts electrically coupled to the light source.

21. A method according to claim 16, wherein the coupling component is ferromagnetic.

* * * * *